US005344139A

United States Patent [19]

Wu

[11] Patent Number: 5,344,139

[45] Date of Patent: Sep. 6, 1994

[54] RACKET SHAFT MOUNTING DEVICE

[75] Inventor: Chao-I Wu, Taichung Hsien, Taiwan

[73] Assignee: Jan Sports Products Corp., Taichung Hsien, Taiwan

[21] Appl. No.: 149,300

[22] Filed: Nov. 9, 1993

[51] Int. Cl.[5] ..... A63B 49/02

[52] U.S. Cl. ..... 273/73 G

[58] Field of Search ..... 273/73 R, 73 G, 73 H, 273/73 K

[56] References Cited

U.S. PATENT DOCUMENTS

| | | | |
|---|---|---|---|
| 4,575,084 | 3/1986 | Yoneyama | 273/73 G |
| 4,690,406 | 9/1987 | Hufenus | 273/73 G X |
| 4,989,871 | 2/1991 | Sheng | 273/73 G |
| 5,006,298 | 4/1991 | Tsai | 273/73 G X |
| 5,217,223 | 6/1993 | Feeney | 273/73 G X |

FOREIGN PATENT DOCUMENTS

| | | | |
|---|---|---|---|
| 616849 | 4/1980 | Switzerland | 273/73 G |
| 2148722 | 6/1985 | United Kingdom | 273/73 G |
| 2151492 | 7/1985 | United Kingdom | 273/73 G |

*Primary Examiner*—William Stoll

*Attorney, Agent, or Firm*—Morton J. Rosenberg; David I. Klein

[57] ABSTRACT

A racket shaft mounting device includes a head frame to hold a network of catgut, and a tubular shaft having a front end connected to the head frame by a connecting device and a rear end terminated to a hand grip, wherein the head frame has two opposite ends fitted one into the other; the connecting device includes a connecting rod having one end fitted into a through hole through the connected two opposite ends of the head frame and an opposite end fitted into the tubular shaft, and a covering layer directly molded on the connecting area between the head frame and the tubular shaft.

4 Claims, 6 Drawing Sheets

RACKET SHAFT MOUNTING DEVICE

BACKGROUND OF THE INVENTION

The present invention relates to a racket shaft mounting device for connecting the shaft of a badminton racket to the head frame thereof which greatly improves the strength of the connection between the head frame and the shaft of the racket.

Referring to FIGS. 1, 2, and 3, a badminton racket according to the prior art is generally comprised of a head frame 10 to hold a network of catgut, and a shaft 20 having a front end connected to the head frame 10 by a connector 30 and a rear end terminated to a hand grip. The connector 30 is made of a T-tube having a transverse tube section 31 defining a transverse mounting hole 311, and a vertical tube section 32 defining a vertical mounting hole 321. During the assembly process, the two opposite ends 101 of the head frame 10 are covered with a bonding agent and then respectively fitted into the transverse mounting hole 311 of the transverse tube section 31 from two opposite ends, and the shaft 20 is covered with a bonding agent and then fitted into the vertical mounting hole 321 of the vertical tube section 32. When the racket hits the ball, a torque M is produced and acted on the connecting area between the head frame 10 and the shaft 20 in the direction in parallel with the connecting surface between the transverse tube section 31 and the head frame 10. Because the connection between the two opposite ends 101 of the head frame 10 and the connector 30 bears the torque M simply by the friction force and the bonding agent therebetween, it may be loosened or damaged easily.

SUMMARY OF THE INVENTION

The present invention has been accomplished to provide a racket shaft mounting device which eliminates the aforesaid problem. According to the present invention, the racket shaft mounting device comprises a head frame to hold a network of catgut, and a tubular shaft having a front end connected to the head frame by a connecting device and a rear end terminated to a hand grip, wherein the head frame has two opposite ends fitted one into the other; the connecting device includes a connecting rod having one end fitted into a through hole through the connected two opposite ends of the head frame and an opposite end fitted into the tubular shaft, and a covering layer directly molded on the connecting area between the head frame and the tubular shaft. The covering layer may be made of plastics directly molded on the connecting area between the head frame and the tubular shaft. Alternatively, the covering layer may be made of a thermosetting fiber compound and molded on the connecting area between said head frame and said shaft through a laminate molding process.

DETAILED DESCRIPTION OF THE PREFERRED EMBODIMENT

Figure 1:
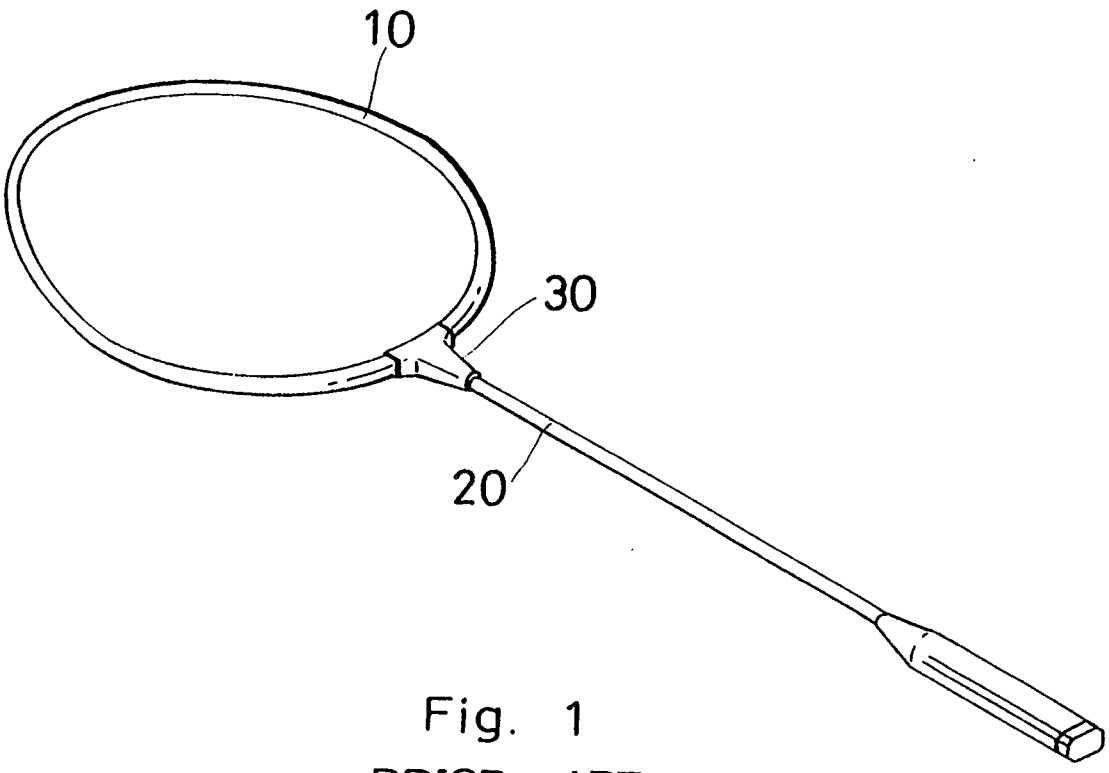
Fig. 1 PRIOR ART
FIG. 1 shows a badminton racket according to the prior art.
Figure 2:
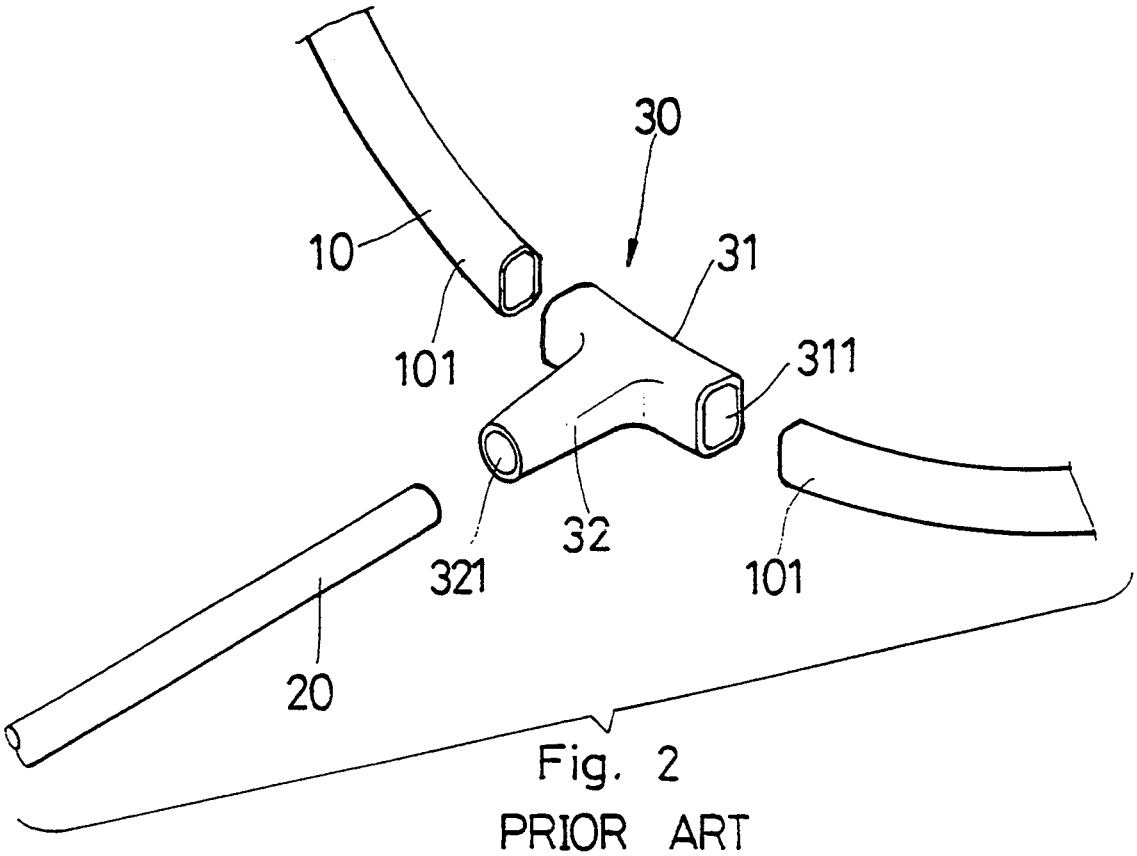
Fig. 2 PRIOR ART
FIG. 2 is an exploded view of of the racket shaft mounting device of the badminton racket shown in FIG. 1.
Figure 3:
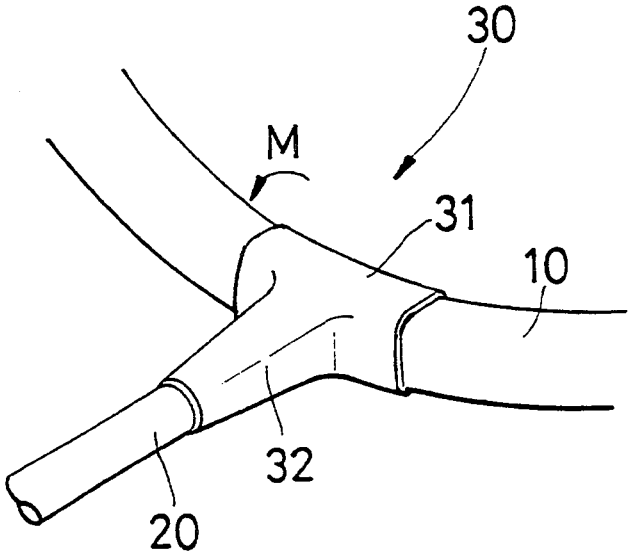
Fig. 3 PRIOR ART
FIG. 3 is an assembly view of FIG. 2.
Figure 4:
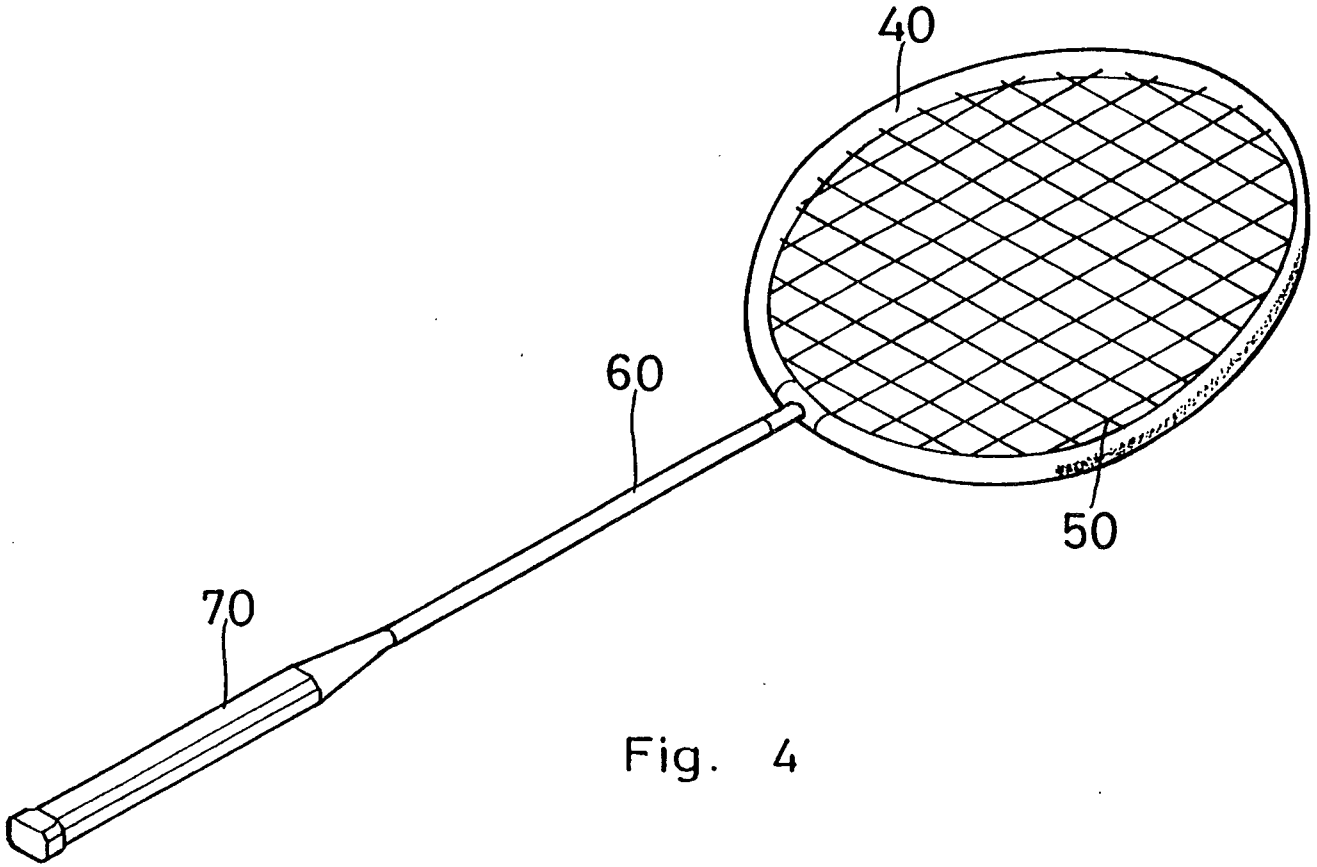
FIG. 4 shows a badminton racket according to the present invention.
Figure 5:
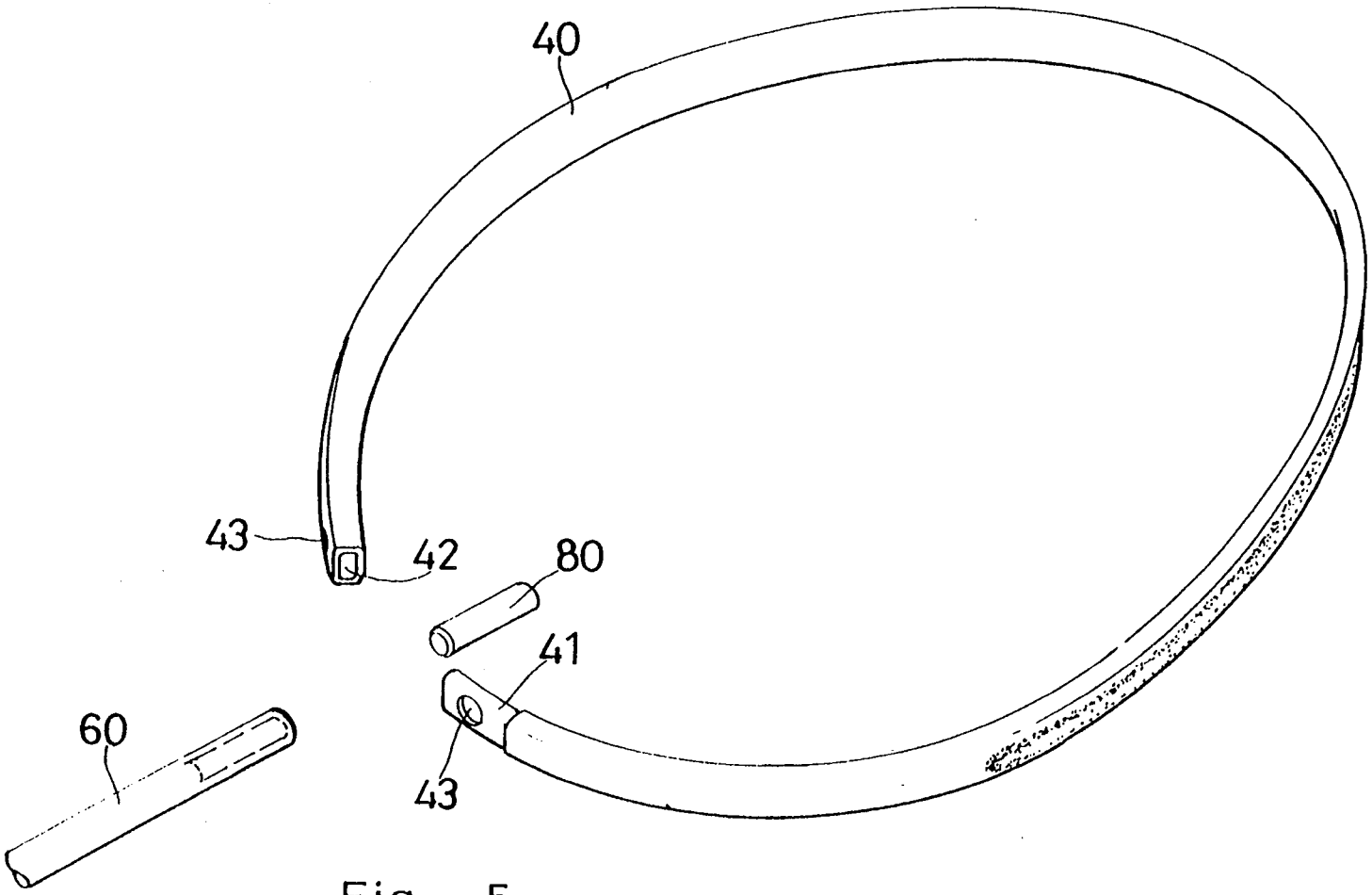
FIG. 5 is an exploded view in an enlarged scale of the racket shaft mounting device of the badminton racket shown in FIG. 4.
Figure 6:
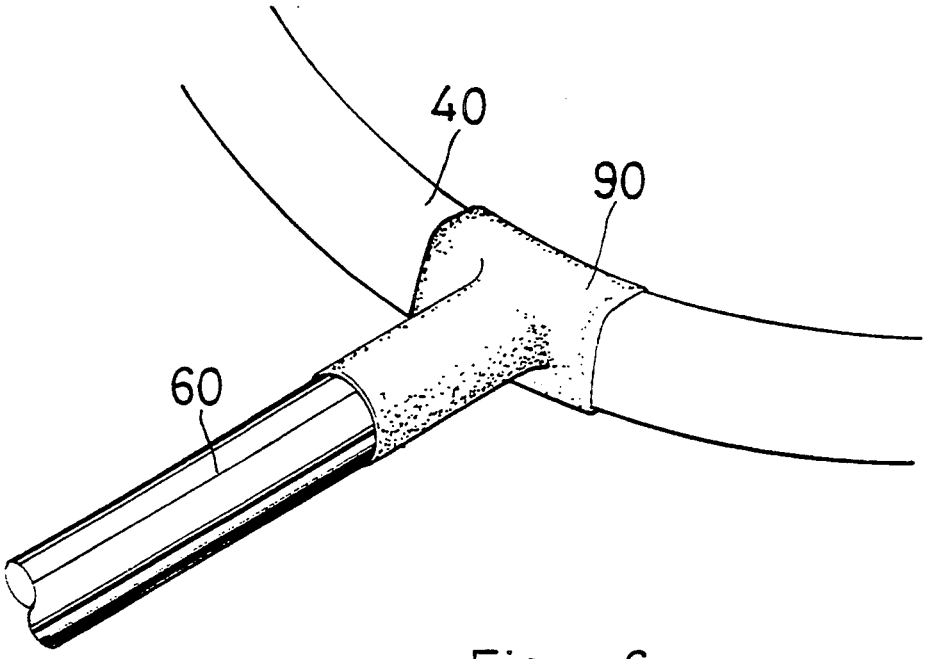
FIG. 6 is an assembly view of FIG. 5.
Figure 7:
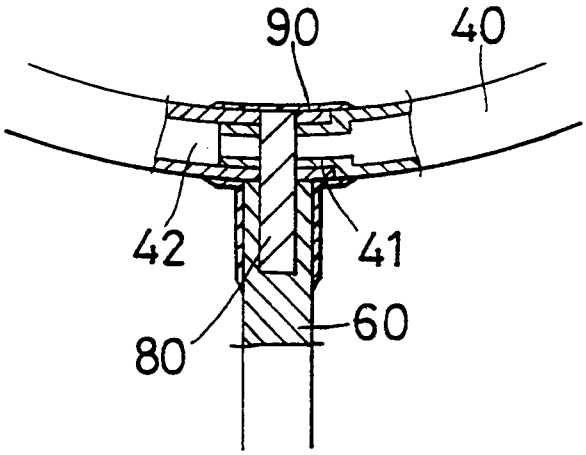
FIG. 7 is a sectional view of FIG. 6.

Referring to FIGS. 4, 5, 6, and 7, a racket for the game of badminton is comprised of a head frame 40, a network of catgut 50 in the head frame 40, a hand grip 70, and a shaft 60 connected between the head frame 40 and the hand grip 70. The head frame 40 is made in the shape of an open loop having a projecting rod 41 on one end thereof and a recess 42 on an opposite end thereof. A through hole 43 is respectively made on either end of the head frame 40 through the projecting rod 41 or the recess 42. As the projecting rod 41 fits into the recess 42, the through holes 43 of the two opposite ends of the head frame 40 are aligned. The shaft 60 is made of a tube having a front end connected to the head frame 40 by a connecting rod 80 and a rear end connected to the hand grip 70. The connecting rod 80 is made of metal or any suitable rigid material stronger than the shaft 60, having one end fitted into the front end of the shaft 60 and an opposite fitted into the through holes 43 on the two opposite ends of the head frame 40. Before inserting into the front end of the shaft 60 and the through holes 43 of the two opposite ends of the head frame 40, the connecting rod 80 is covered with a layer of bonding agent. When connected, a plastic covering layer 90 is molded on the connecting area between the head frame 40 and the shaft 60 to improve the strength and to make it beautiful.

Figure 8:
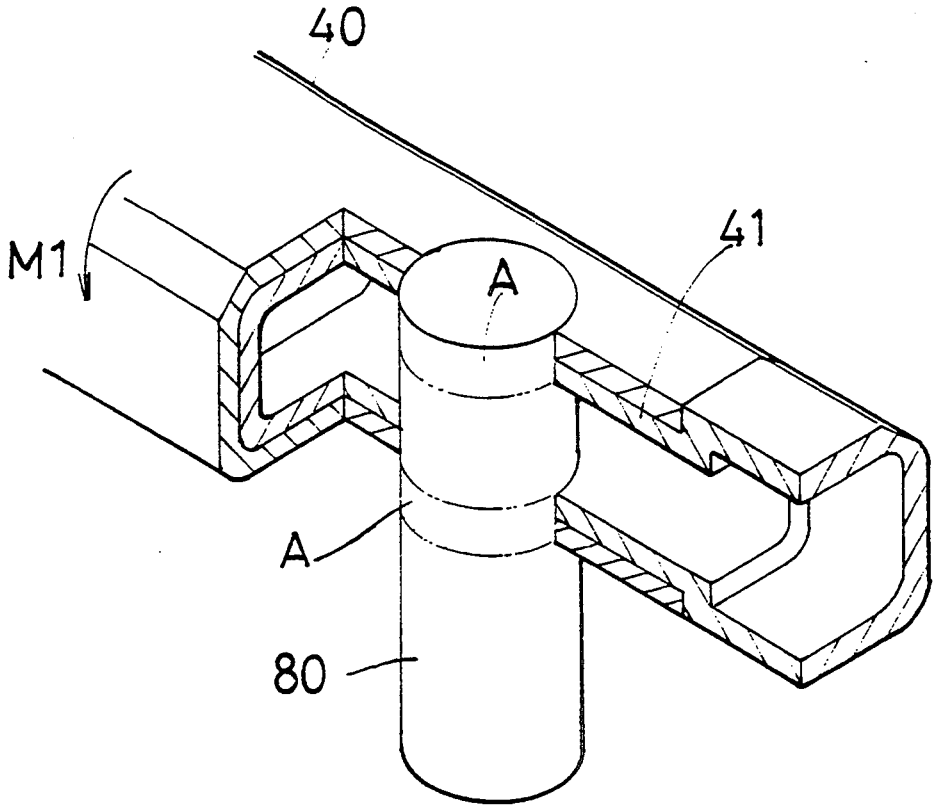
FIG. 8 is a cutaway showing the direction of the torque acted on the racket shaft mounting device of the badminton racket shown in FIG. 4.

Referring to FIG. 8, when the racket hits the ball, the torque M1 is acted on the racket frame is perpendicular to the connecting surface A between the head frame 40 and the connecting rod 80, therefore the connection between the head frame 40 and the connecting rod 80 utilizes the whole connecting surface A to bear against the torque M1. Therefore, the connection between the head frame 40 and the connecting rod 80 is very strong and will not be damaged by the torque M1.

By using a different material to make the connecting rod 80, the local weight at the connecting area between the head frame 40 and the shaft 60 is changed, and therefore the center of gravity of the racket can be changed in this manner.

The covering layer 90 smoothes the connecting area between the head frame 40 and the shaft 60, and simultaneously gives a binding force to hold the head frame 40, the shaft 60, and the connecting rod 80 tightly together. As an alternate form of the present invention, the covering layer 90 may be made of a thermosetting fiber compound through a laminate molding process. Of course, any suitable material may be used to make the covering layer 90 on the frame of the racket.

What is claimed is:

1. A racket shaft mounting device comprising a head frame to hold a network of catgut, a shaft having a rear end terminated to a hand grip and a front end connected to said head frame by a connecting device, wherein said head frame is made in the shape of an open loop having a projecting rod with a first through hole on one end thereof, a recess and a second through hole on an opposite end thereof, said projecting rod being fitted into said recess permitting said first and second through holes to be aligned; said connecting device comprises a connecting rod having one end fitted into said first and second through hole and an opposite end fitted into a hole on the front end of said shaft, and a thermosetting covering layer covered over the connecting area between said head frame and said shaft.

2. The racket shaft mounting device of claim 1 wherein said covering layer is made of plastics directly molded on the connecting area between said head frame and said shaft.

3. The racket shaft mounting device of claim 1 wherein said covering layer is made of a thermosetting fiber compound and molded on the connecting area between said head frame and said shaft through a laminate molding process.

4. The racket shaft mounting device of claim 1 wherein the strength of structure of said connecting rod is stronger than that of said shaft.

* * * * *